US007648344B2

(12) United States Patent
Wenckebach et al.

(10) Patent No.: US 7,648,344 B2
(45) Date of Patent: Jan. 19, 2010

(54) LIQUID RING PUMP

(75) Inventors: Bernd Wenckebach, Itzehoe (DE); Silke Heetsch, Itzehoe (DE); Alfons Jünemann, Itzehoe (DE)

(73) Assignee: Sterling Fluid Systems (Germany) GmbH, Itzehoe (DE)

( * ) Notice: Subject to any disclaimer, the term of this patent is extended or adjusted under 35 U.S.C. 154(b) by 372 days.

(21) Appl. No.: 10/556,748

(22) PCT Filed: May 4, 2004

(86) PCT No.: PCT/EP2004/004742

§ 371 (c)(1),
(2), (4) Date: Nov. 14, 2005

(87) PCT Pub. No.: WO2004/102002

PCT Pub. Date: Nov. 25, 2004

(65) Prior Publication Data

US 2006/0292000 A1 Dec. 28, 2006

(30) Foreign Application Priority Data

May 16, 2003 (EP) ..... 03011219

(51) Int. Cl.
*F04C 19/00* (2006.01)

(52) U.S. Cl. ..... 417/68

(58) Field of Classification Search ..... 417/68
See application file for complete search history.

(56) References Cited

U.S. PATENT DOCUMENTS

| | | | | | |
|---|---|---|---|---|---|
| 3,228,587 | A * | 1/1966 | Segebrecht | ..... | 417/62 |
| 3,366,314 | A * | 1/1968 | Schroder | ..... | 417/68 |
| 4,132,504 | A * | 1/1979 | Fitch | ..... | 417/68 |
| 4,685,865 | A * | 8/1987 | Auschrat | ..... | 417/68 |
| 4,817,265 | A * | 4/1989 | Trimborn | ..... | 29/527.6 |
| 6,551,071 | B1 * | 4/2003 | Blender et al. | ..... | 417/68 |

FOREIGN PATENT DOCUMENTS

| | | |
|---|---|---|
| DE | 10 57 284 B | 5/1959 |
| DE | 197 58 340 A | 7/1999 |
| DE | 101 21 800 C | 8/2002 |

* cited by examiner

*Primary Examiner*—Charles G Freay
(74) *Attorney, Agent, or Firm*—Alix, Yale & Ristas, LLP

(57) ABSTRACT

Disclosed is a liquid ring pump with one or several stages, each of which comprises a working chamber, an impeller that is eccentrically mounted therein, flat control disks that axially delimit the working chamber on both sides, and ducts or chambers that are located adjacent to the control disks and deliver and discharge the transport gas to and from the working chamber. The inventive liquid ring pump is characterized in that the control disks are embodied in the same manner with identical suction ports and pressure ports while ports that are not needed are covered on the side facing away from the impeller.

13 Claims, 5 Drawing Sheets

LIQUID RING PUMP

BACKGROUND OF THE INVENTION

The invention relates to a liquid ring gas pump having one or more stages, which each have a working space, an impeller eccentrically mounted therein, control discs that bound the working space axially on both sides, and adjacent ducts or chambers for the supply and discharge of the conveyed gas to and from the working space, the control discs being formed identically to each other with identical suction and pressure openings.

In liquid ring gas pumps, an impeller rotates within an eccentrically circulating liquid ring. During the circulation, the liquid ring penetrates to a greater or lesser extent into the cells formed between the vanes of the impeller. As a result, the free volume in the impeller cells is alternately enlarged and reduced. In that region of the revolution in which the cell volume is enlarged, the suction opening, through which the gas to be conveyed is taken into the cells, is located at the end in a control disc. In the end region of that part of the revolution in which the compression is carried out, there is the pressure opening, through which the compressed gas in the pressure space of the pump is exhausted.

Liquid ring gas pumps are employed both as a vacuum pump, where they convey the gas compressed from a negative pressure to approximately atmospheric pressure, and also as a compressor, in which they convey the gas compressed from atmospheric pressure to a positive pressure. There are liquid ring gas pumps as single-stage and multi-stage designs. Single-stage liquid ring gas pumps can be applied as a vacuum pump in the upper coarse vacuum or as a compressor, on account of the lower compression ratio. Two-stage machines have their preferred range of use as a vacuum pump in the lower pressure range of the vacuum.

The working spaces in which the impeller rotates and in which the liquid ring is built up are bounded axially on one side or on both sides by a control disc. In the case of multi-stage liquid ring pumps, these working spaces with impeller and control discs are arranged one after another axially in an appropriate number.

Traditionally, a liquid ring gas pump comprises a large number of components which are arranged on one another in the axial direction during the pump assembly. The supporting surfaces of the individual components are at the same time sealing surfaces of the machine from the pump interior to the environment. Axially on the outside, the control discs are adjoined by the outer housings, in which the ducts or chambers for the guidance of the gas and liquid streams are contained. Surfaces which in turn have to be sealed off are also present between the control discs and the outer housings.

The control discs have openings which ensure the inflow and outflow of the conveyed gas from the outer compressor housing to and from the working space. Depending on the number of stages and the design of the liquid ring gas pump, one or two openings are provided in these control discs for the inflow (suction opening) and outflow (pressure opening) of the conveyed medium. Because of the compression of the gas in each liquid ring stage, the pressure opening is generally designed to be smaller than the suction opening. The exact position and the geometric contours of the openings have a great influence on the achievable intake volume flow and the efficiency. Therefore, the shape and size of the suction and pressure openings also differ in practice.

In the case of this classical pump design, the control discs are implemented differently in design terms. For example, in the two-stage pump, each of the four control discs has a different geometry. The two axially outer control discs each have a suction and a pressure opening; the central control disc of the first stage has only the pressure opening, and the central control disc of the second stage has only the suction opening. Since, conventionally, the control discs are implemented as cast parts, even the two outer control discs are different in design terms, since the openings and the centering means with respect to the housing are arranged in mirror-image fashion. The disadvantage of this conventional pump design is the large number of different components, which cause a high degree of complexity in production, the purchasing of raw parts, the machining of parts and the stockholding. High unit and processing costs are the result.

Already known are first approaches to configuring the control discs more simply as flat discs with a constant thickness (EP 0 678 674 A2). This makes it possible to design symmetrical control discs as a standard component. In production, these control discs can be punched out of flat metal sheets or machined using laser technology. In addition, it is frequently necessary to adapt the adjacent flow ducts in the adjacent housing parts in such a way that the optimum flow conditions are achieved. For example, in the prior art cited, the outlet from the working space in the pressure slot is of a stepped design, by which means a curved flow duct is approximately modeled.

Entirely standard control discs, which are designed as flat components, have previously been used only in single-stage liquid ring gas pumps, since, with a standard configuration, these always have a suction opening and a pressure opening (DE 10 57 274 B, DE 197 58 340 A1). For instance, for multi-stage pumps in which the central control discs have only one opening in each case, at least three different designs of the control discs would be necessary.

The object of the invention is to provide a liquid ring gas pump of the type in which the number of different control discs is reduced.

SUMMARY OF THE INVENTION

The solution according to the invention resides in the fact that no conveyed gas flows through at least one of the openings during the operation of the pump, and that these unneeded openings are covered on the side facing away from the impeller.

The invention can be used for single-stage liquid ring gas pumps but in particular for multi-stage liquid ring gas pumps.

The liquid ring gas pump according to the invention has only control discs in an identical geometric design. This is made possible by the fact that the unneeded openings are covered by adjacent components on the side facing away from the impeller. In this case, it is not necessary for the remaining open space in the unneeded opening in the control disc to be filled, although it would be supposed that the efficiency would be impaired by this additional space, in which there is also gas to be pumped. Astonishingly, however, the liquid ring gas pump according to the invention functions with the same performance data as a liquid ring gas pump without the corresponding open spaces in the control discs, since the opening which is respectively covered on the outside in the working space is located axially opposite the opening to the associated flow ducts. In this position of the impeller, identical pressures are present in the adjacent impeller cells during the compression operation, which means that virtually no reverse flows occur. It has also been verified experimentally that there is no negative influence on the intake volume flow of the liquid ring gas pump.

Even in single-stage pumps with diagonal through flow, in which in each case only one opening is used on the suction and pressure side, the invention can be used if the respectively unused suction or pressure opening is covered. According to the invention, therefore, complete liquid ring gas pump series, comprising single-stage and multi-stage machines and compressor stages with different axial lengths, can be equipped at all points with the same standard control discs. As a result of the invention, an important reduction in the number of different components is achieved. This means that marked savings in the fabrication and assembly process accrue. The production costs of such a liquid ring gas pump and are therefore considerably lower.

Provision is advantageously made for the control discs to contain further openings (holes) which are required for the function of the compressor, for example for the liquid, and which are optionally open or covered.

In the case of a single-stage design of the pump, in which the outer control discs on both sides need both the suction opening and the pressure opening, the suction and pressure openings are uncovered.

The standard control discs are expediently flat plates and have a suction opening and a pressure opening. However, the standard control discs can also be cast parts and then likewise contain a suction opening and a pressure opening.

If the control discs are produced by punching, laser cutting or water-jet cutting, in many cases no further machining is necessary.

BRIEF DESCRIPTION OF THE DRAWINGS

The invention will be described in he following text using advantageous embodiments and with reference to the appended drawings, in which.

DETAILED DESCRIPTION OF THE PREFERRED EMBODIMENTS

Figure 1:
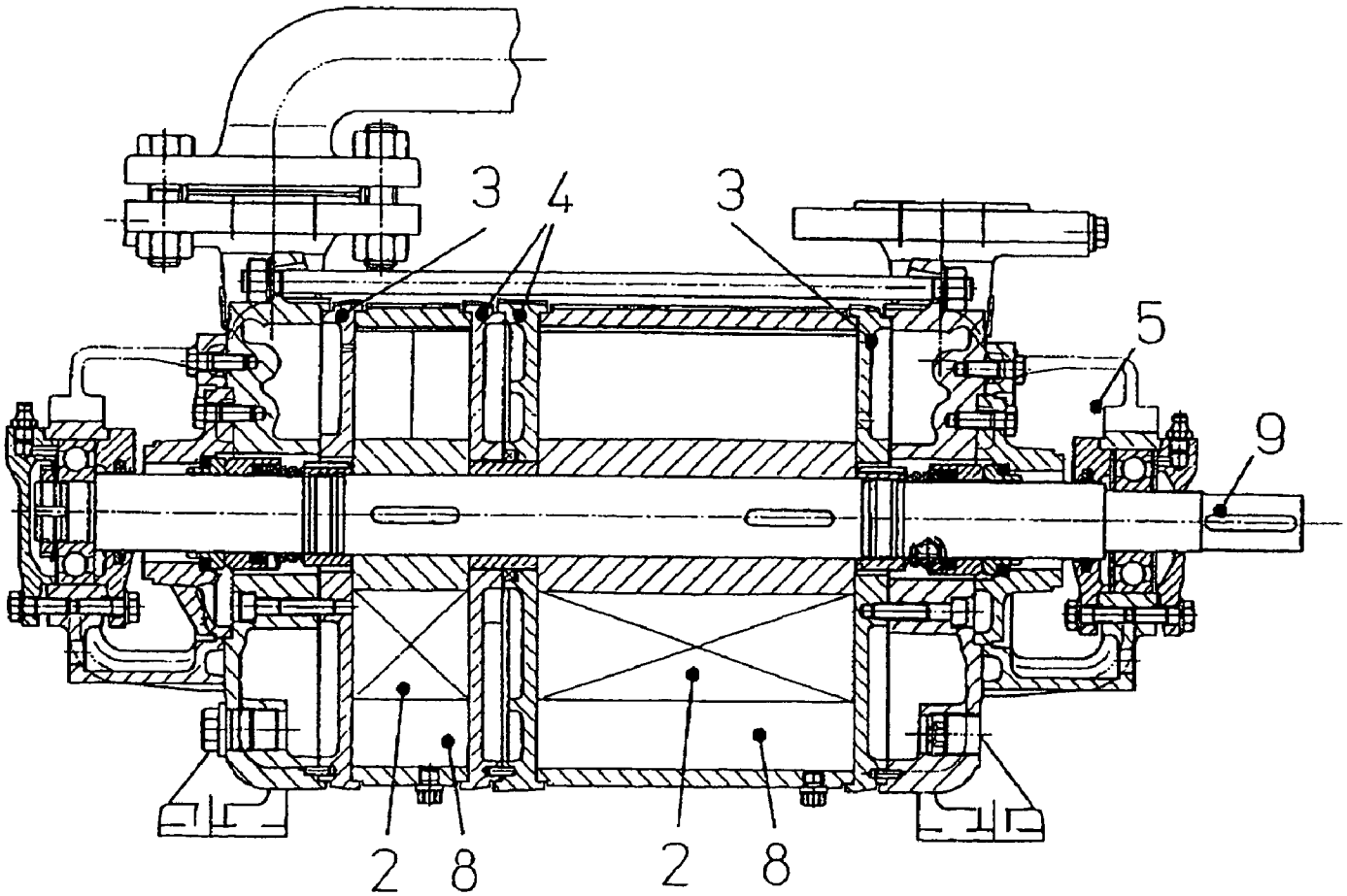
Fig. 1 Prior art
FIG. 1 shows a liquid ring gas pump from the prior art in cross section.

FIG. 1 shows a conventional two-stage liquid ring gas pump. This has two impellers 2, which are arranged in two working spaces 8 and are carried by a shaft 9. The working spaces 8 are bounded axially by control discs 3, 4. As can be seen, four different control discs are needed.

Figure 2:
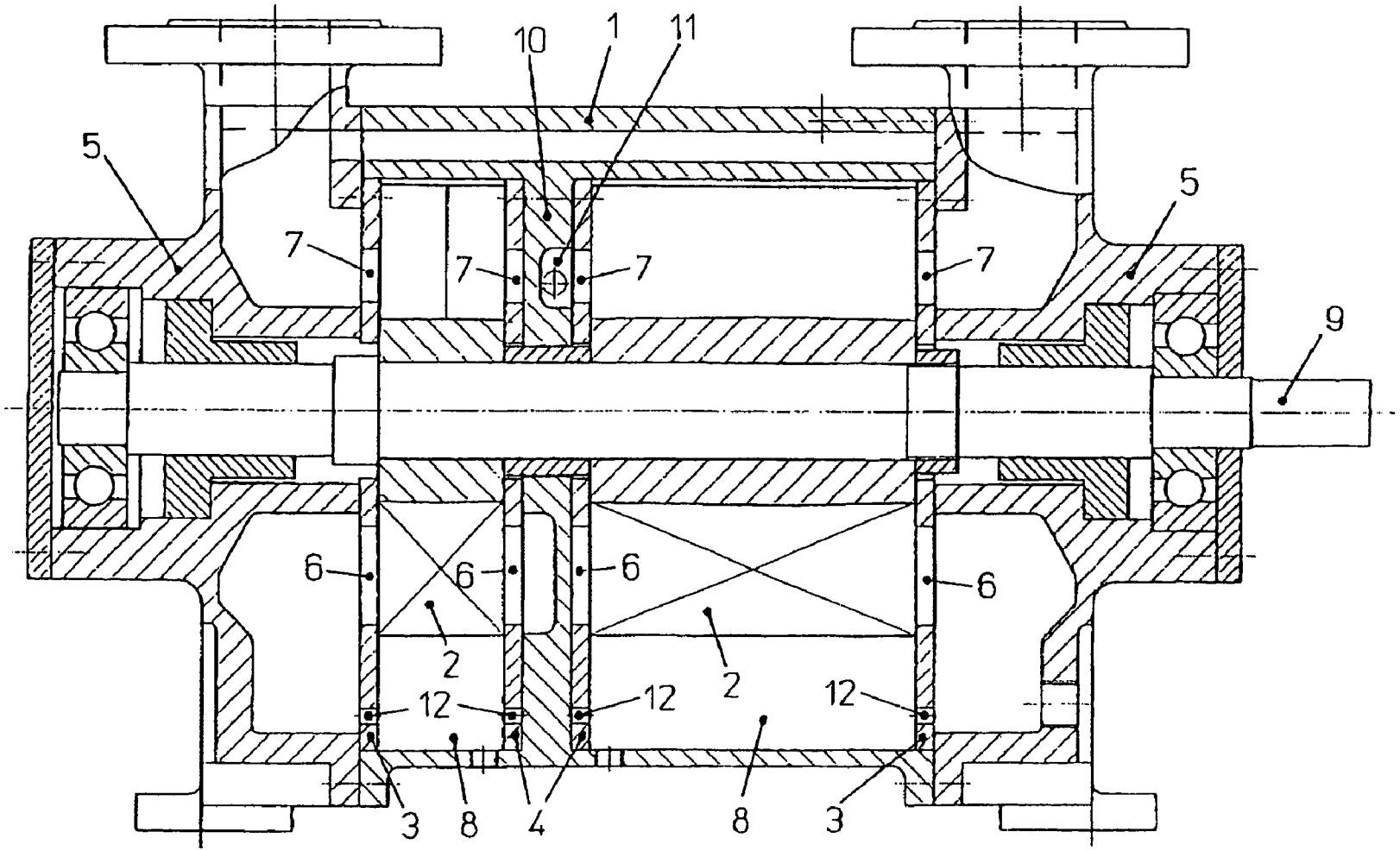
FIG. 2 shows a first embodiment of a liquid ring gas pump according to the invention.

FIG. 2 shows a pump according to the invention in a similar illustration, in which pump the control discs 3, 4 with the suction openings 6 and pressure openings 7 are formed identically to each another. In this case, the pressure opening 7 of the inner control disc 4 of the left (second) stage, and the suction opening 6 of the inner control disc 4 of the right (first) stage are covered by an intermediate wall 10. The pressure opening of the inner control disc 4 of the right stage is connected via a duct 11 to the suction opening of the inner control disc 4 of the left stage. 12 designates further openings required for the function of the pump.

Figure 3:
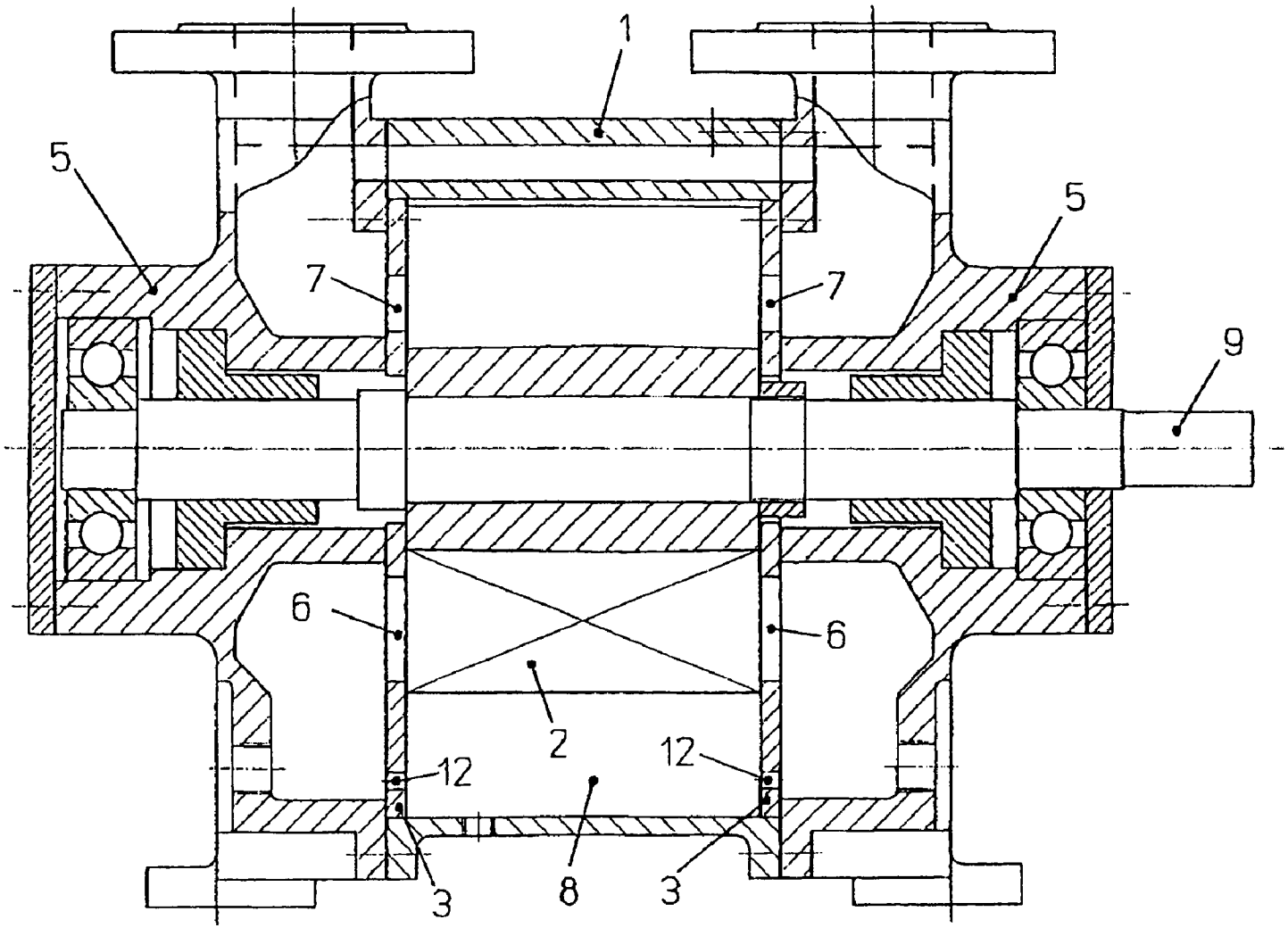
FIG. 3 shows a second form of a liquid ring gas pump according to the invention.

FIG. 3 shows a single-stage pump, in which the two control discs 3 with the suction opening 6 and the pressure opening 7 are formed identically.

Figure 4:
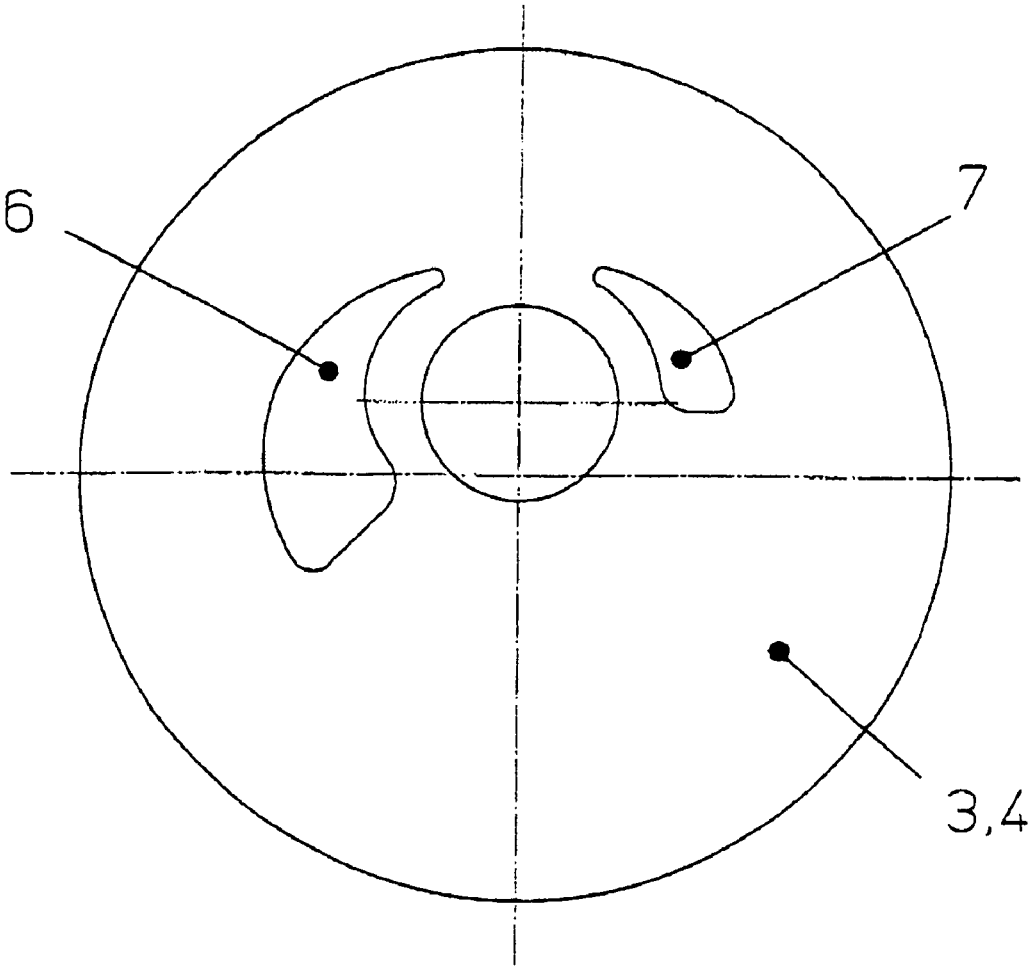
FIG. 4 shows a control disc according to the invention in plan view.

FIG. 4 shows a plan view of a control disc 3, 4 with the suction opening 6 and the pressure opening 7.

Figure 5:
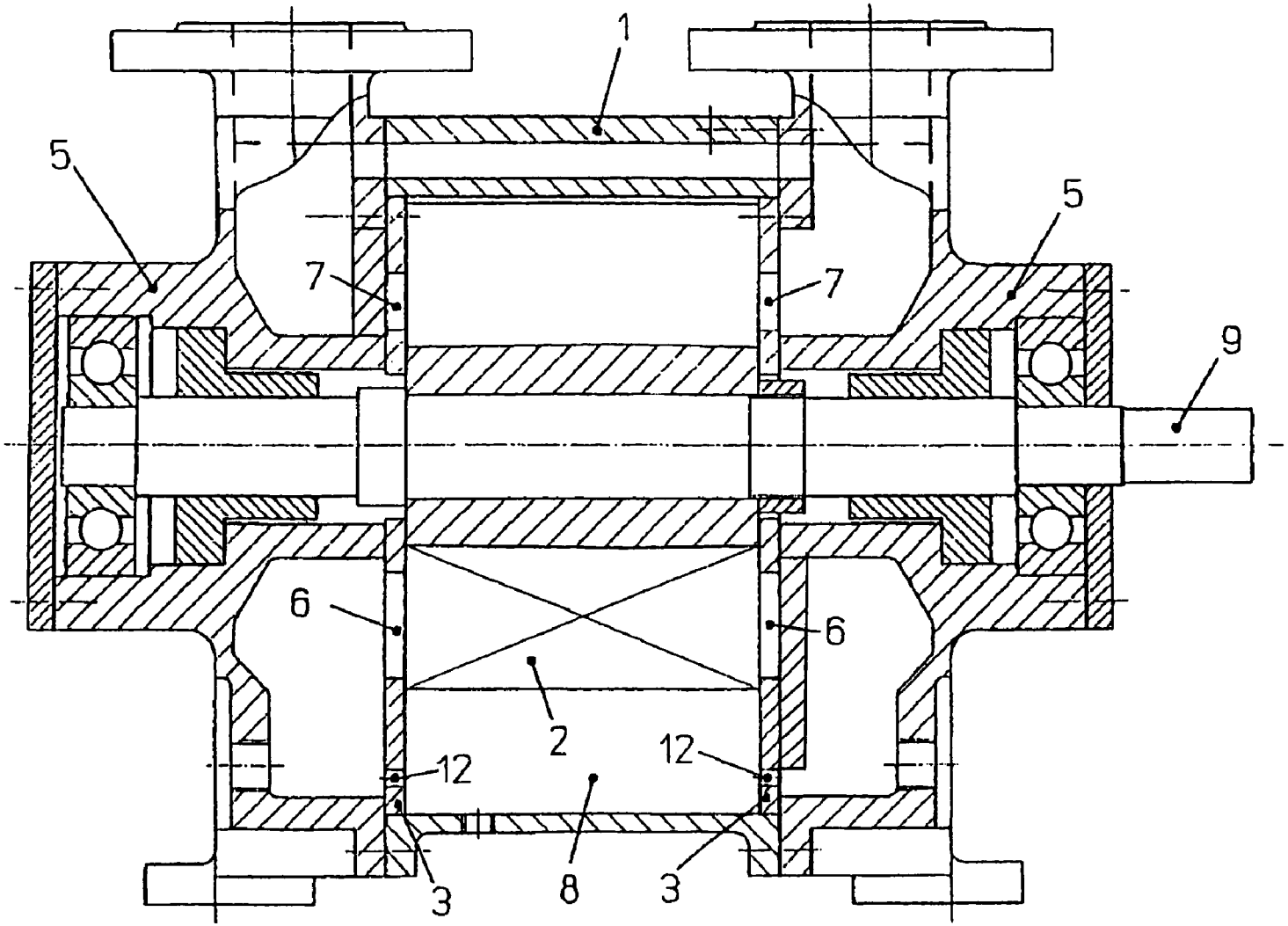
FIG. 5 shows another embodiment of a liquid ring gas pump according to the invention.

Finally, FIG. 5 shows a single-stage pump, in which the two control discs 3 with the suction opening 6 and the pressure opening 7 are formed identically, the suction opening 6 on one side and the pressure opening 7 on the other side each being covered by a part of the housing 5.

The invention claimed is:

1. A liquid ring gas pump having one or more stages, which each have a working space, an impeller eccentrically mounted therein, control discs that bound the working space axially on both sides, and adjacent ducts or chambers for the supply and discharge of the conveyed gas to and from the working space, the control discs being formed identically to each other with identical suction and pressure openings to form a standard control disc, characterized in that there is at least one unused opening through which no conveyed gas flows during the operation of the pump, each said unused opening being permanently covered on the side facing away from the impeller by an adjacent separate housing part during operation of the pump.

2. The liquid ring gas pump as claimed in claim 1, characterized in that, in a multi-stage design, in the control discs arranged between two impellers, the unused openings are covered.

3. The liquid ring gas pump as claimed in claim 2, characterized in that the control discs contain further openings that are needed for the function of the compressor, which are optionally open or covered.

4. The liquid ring gas pump as claimed in claim 2, characterized in that the standard control discs are flat plates and contain a suction opening and a pressure opening.

5. The liquid ring gas pump as claimed in claim 3, characterized in that the standard control discs are flat plates and contain a suction opening and a pressure opening.

6. The liquid ring gas pump as claimed in claim 1, characterized in that, in a single-stage design, in the control disc the suction opening on one side and the pressure opening on the other side are covered.

7. The liquid ring gas pump as claimed in claim 6, characterized in that the control discs contain further openings that are needed for the function of the compressor, which are optionally open or covered.

8. The liquid ring gas pump as claimed in claim 6, characterized in that the standard control discs are flat plates and contain a suction opening and a pressure opening.

9. The liquid ring gas pump as claimed in claim 1, characterized in that the control discs contain further openings that are needed for the function of the compressor, which are optionally open or covered.

10. The liquid ring gas pump as claimed in claim 9, characterized in that the standard control discs are flat plates and contain a suction opening and a pressure opening.

11. The liquid ring gas pump as claimed in claim 1, characterized in that the standard control discs are flat plates and contain a suction opening and a pressure opening.

12. The liquid ring gas pump as claimed in claim 1, characterized in that the control discs are produced by punching, laser cutting or water-jet cutting.

13. The liquid ring gas pump as claimed in claim 1, characterized in that the standard control discs are cast parts and contain a suction opening and a pressure opening.

* * * * *